US005237241A

United States Patent [19]

Hashimoto

[11] Patent Number: 5,237,241

[45] Date of Patent: Aug. 17, 1993

[54] COLD-CATHODE FLUORESCENT DISCHARGE TUBE

[75] Inventor: Kazuo Hashimoto, Tokyo, Japan

[73] Assignee: Sony Corporation, Japan

[21] Appl. No.: 880,594

[22] Filed: May 8, 1992

[30] Foreign Application Priority Data

May 20, 1991 [JP] Japan ..... 3-115023

[51] Int. Cl.[5] ..... H05B 41/00

[52] U.S. Cl. ..... 315/60; 315/76; 315/326; 315/DIG. 5

[58] Field of Search ..... 315/60, 76, 124, 168, 315/203, 204, 209 CD, 209 M, 234, 261, 262, 263, 264, 326, 330, 331, 332, 335, 336, DIG. 5

[56] References Cited

U.S. PATENT DOCUMENTS 2,287,834 6/1942 Ruben ..... 315/336
2,301,670 11/1942 Abade ..... 315/60
2,506,740 5/1950 Reitherman ..... 315/60
3,866,088 2/1975 Kaneda et al. ..... 315/105
4,064,416 12/1977 Krense et al. ..... 315/335 X

*Primary Examiner*—David Mis
*Attorney, Agent, or Firm*—Ronald P. Kananen

[57] ABSTRACT

A cold-cathode fluorescent discharge tube has a pair of electrodes for performing discharge between the electrodes in response to the application of a voltage therebetween. The fluorescent discharge tube of the invention includes an auxiliary electrode provided in the vicinity of one of the pair of electrodes, and a unit for applying the voltage between the pair of electrodes and between the auxiliary electrode and the one of the electrodes. With the auxiliary electrode, a discharge is firstly started between the auxiliary electrode and the one of the electrodes in response to the application of the voltage between the pair of electrodes. Thereafter, a discharge is started between the pair of electrodes. Thus, the start discharge is generated in the discharge tube in a relatively short period of time even if the discharge tube is set in the off state for a long time, particularly in the dark at a low temperature.

6 Claims, 3 Drawing Sheets

COLD-CATHODE FLUORESCENT DISCHARGE TUBE

BACKGROUND OF THE INVENTION

1. Field of the Invention

The present invention generally relates to fluorescent light bulbs or tubes and, more particularly, is directed to a cold-cathode fluorescent discharge tube for use in a back-light of a liquid crystal display device.

2. Description of the Related Art

The cold-cathode fluorescent discharge tube does not have a filament, so that it is advantageous when compared with a hot-cathode one in that it is small in size, high in reliability and long in life. In view of these advantages, the cold-cathode fluorescent discharge tube has been used in a back-light of a liquid crystal display for a notebook sized personal computer or the like.

In order to turn on the cold-cathode fluorescent discharge tube, a relatively high voltage is required to be applied between electrodes from an inverter so as to start the emission of radiation or discharge therebetween.

However, the conventional cold-cathode fluorescent discharge tube has such a property that it does not quickly start the discharge in response to the application of the voltage between the electrodes when it has been placed in a turned-off state for a long time, particularly, in a dark and low temperature state. Thus, it sometimes takes about one minute to place the cold-cathode fluorescent discharge tube into a stable discharge state or turn-on state after the application of the voltage. Namely, the conventional cold-cathode fluorescent discharge tube has a problem of slow start.

In order to overcome this problem, it has been suggested to increase the output voltage of the inverter. However, the increase of the voltage does not necessarily improve the start characteristic, but does enlarge an area of a wiring board mounting parts for the discharge tube because the high voltage is applied to wirings on the board. Accordingly, the size of the discharge tube becomes larger and the cost thereof becomes expensive.

OBJECTS AND SUMMARY OF THE INVENTION

Therefore, it is an object of the present invention to provide an improved cold-cathode fluorescent discharge tube in which the aforementioned shortcomings and disadvantages encountered with the prior art can be eliminated.

More specifically, it is an object of the present invention to provide a cold-cathode fluorescent discharge tube which can be placed in a stable discharge state surely and in a short time after the application of voltage between electrodes thereof.

As an aspect of the present invention, a cold-cathode fluorescent discharge tube having a pair of electrodes for performing discharge therebetween in response to the application of voltage therebetween is comprised of an auxiliary electrode provided in the vicinity of one of the pair of electrodes, and a unit for applying voltage between the pair of electrodes and between the auxiliary electrode and the one of the electrodes, whereby discharge is firstly started between the auxiliary electrode and the one of the electrodes in response to the application of the voltage between the pair of electrodes, and thereafter discharge is started between the pair of electrodes.

The preceding and other objects, features, and advantages of the present invention will become apparent from the following detailed description of illustrative embodiments thereof when read in conjunction with the accompanying drawings, in which like reference numerals are used to identify the same or similar parts in the several views.

DETAILED DESCRIPTION OF THE PREFERRED EMBODIMENTS

A cold-cathode fluorescent discharge tube according to the first embodiment will now be described with reference to FIG. 1.

Figure 1:
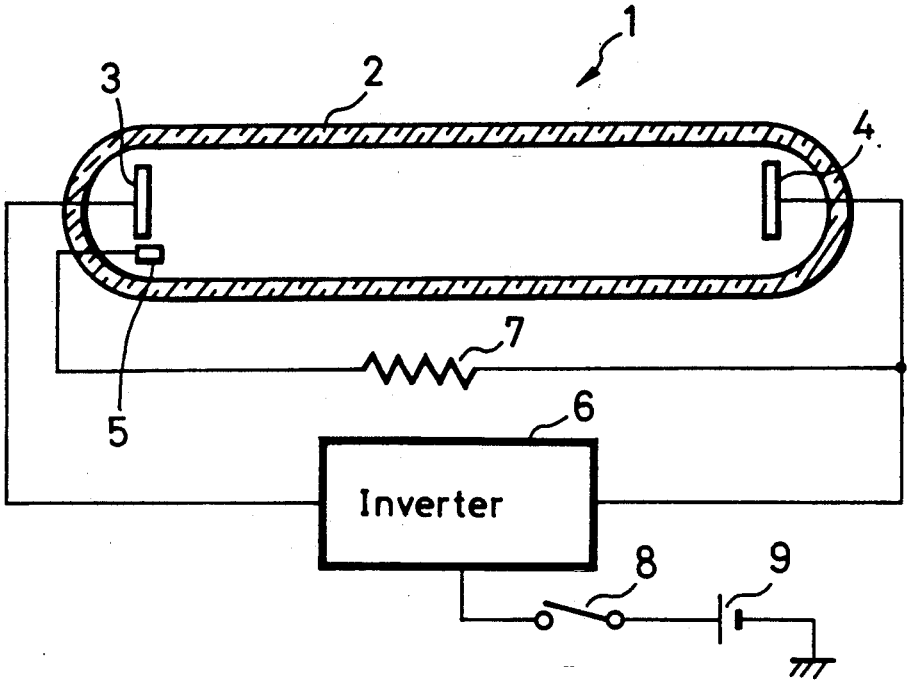
FIG. 1 shows a fragmental sectional view of an arrangement of a cold-cathode fluorescent discharge tube according to a first embodiment of the present invention.

FIG. 1 of the accompanying drawings shows an arrangement of the first embodiment of the present invention. Referring to FIG. 1, a cold-cathode fluorescent discharge tube 1 has a tubular glass bulb 2, electrodes 3 and 4, and an auxiliary electrode 5 provided in the vicinity of the electrode 3, for example. The phosphor is coated on the inner surface of the bulb 2, and a gas such as argon Ar, mercury Hg or the like is sealed within the bulb 2 at low pressure (about 1/100 atm).

The electrodes 3 and 4 are respectively connected to both output terminals of an inverter 6 serving as a high voltage source. The auxiliary electrode 5 is connected to the electrode 4, positioned at the opposite end of the bulb 2, through a resistor 7 having a relatively high resistance, e.g., in a range between 500 kΩ and 1MΩ. An input terminal of the inverter 6 is connected to a battery 9 serving as a d.c. voltage source through a switch 8.

Operation of the first embodiment shown in FIG. 1 will be explained below.

Firstly, when the switch 8 is turned on, the d.c. voltage from the battery 9 is supplied to the inverter 6, which in turn is energized to generate a high voltage of about 2 kV across both output terminals thereof. The high voltage is applied not only between the electrodes 3 and 4 but also between the electrode 3 and the auxiliary electrode 5 through the resistor 7. Thus, the discharge is initiated firstly between the electrode 3 and the auxiliary electrode 5. Namely, since the electric field in the bulb 2 is uniform and the field intensity is inversely proportional to a space distance, the discharge is firstly initiated between the electrodes 3 and 5 because a distance therebetween is shorter than that between the electrodes 3 and 4.

The discharge between the electrode 3 and the auxiliary electrode 5 causes charged particles in the bulb 2 to be generated. In this state, a current flowing into the auxiliary electrode 5 is limited due to the resistor 7, and so the high voltage of the inverter 6 is maintained across the electrodes 3 and 4. Thus, the discharge is surely initiated between the electrodes 3 and 4 by the charged particles, so that a stable discharge state can be formed between the electrodes 3 and 4 in a relatively short time after the turn-on of the switch 8. When the stable discharge state is formed, the voltage between the electrodes 3 and 4 is stably kept at about 500 V. Further, in this stable discharge state, an equivalent resistance between the electrodes 3 and 4 will be in a range between about 20 kΩ and 50 kΩ.

According to the thus constituted embodiment, since the auxiliary electrode 5 is formed in the vicinity of the electrode 3, the discharge is firstly started between the electrode 3 and the auxiliary electrode 5 in response to the application of the voltage between the electrodes 3 and 4, thereby generating the charged particles in the bulb 2. Then, the discharge is surely started between the electrodes 3 and 4 by the charged particles, so that a stable discharge state can be formed between the electrodes 3 and 4 in a relatively short time after the application of power. Accordingly, it is possible to form the stable discharge state in a relatively short time due to the function associated with the auxiliary electrode 5 even if the cold-cathode fluorescent discharge tube has been placed in a turned-off state for a long time, particularly, in a dark and low temperature state.

Figure 2:
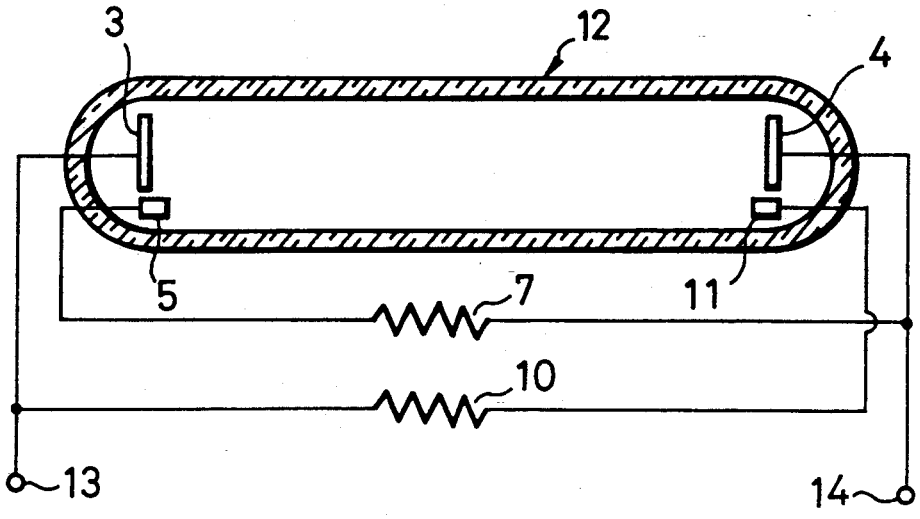
FIG. 2 shows a fragmental sectional view of an arrangement of a cold-cathode fluorescent discharge tube according to a second embodiment.

While, in the above-described embodiment shown in FIG. 1, the auxiliary electrode 5 is provided only at the side of the electrode 3, the present invention may be modified in a manner so that another auxiliary electrode is provided at the side of the electrode 4 as shown in FIG. 2.

Referring to FIG. 2, which illustrates a cold-cathode fluorescent discharge tube 12 according to a second embodiment, an auxiliary electrode 11 is provided in the vicinity of the electrode 4 in addition to the auxiliary electrode 5, and is connected to the electrode 3 through a resistor 10. In the thus constituted cold-cathode fluorescent discharge tube 12, the stable discharge can be formed more surely and rapidly when compared with the first embodiment in response to the application of the high voltage between the electrodes 3 and 4 through terminals 13 and 14 the terminals of which are respectively connected to the output of the inverter 6 (not shown in FIG. 2).

Figure 3:
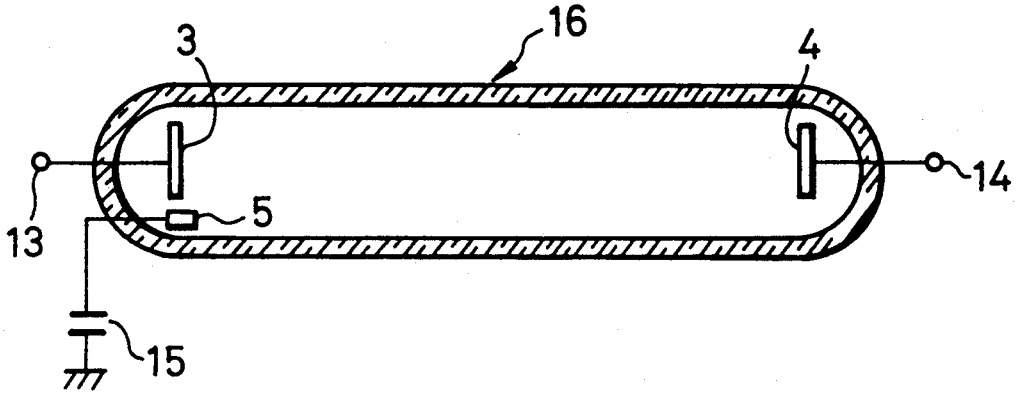
FIG. 3 shows a fragmental sectional view of an arrangement of a cold-cathode fluorescent discharge tube according to a third embodiment.

Further, although, in the above-described embodiment shown in FIG. 1, the auxiliary electrode 5 is connected to the output of the inverter 6 through the resistor 7, the present invention may be modified such that the auxiliary electrode 5 is connected to the ground through a capacitor as shown in FIG. 3. Namely, referring to FIG. 3 which illustrates a cold-cathode fluorescent discharge tube 16 according to a third embodiment, the auxiliary electrode 5 is grounded through a capacitor 15 and the output voltage from the inverter 6 is applied between terminals 13 and 14, which are respectively connected to the electrodes 3 and 4. When the cold-cathode fluorescent tube 16 is mounted on a double-sided wiring board, the capacitor 15 may be formed by the board itself serving as dielectric, that is, a capacitor which electrodes are formed on both sides of the board as wiring pattern.

Figure 4A:
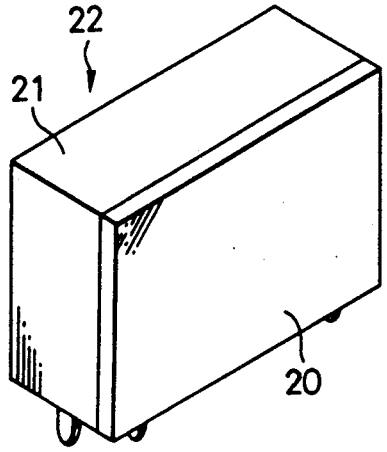
FIG. 4A shows a perspective view of a back-light of a liquid crystal display to which there is applied the cold-cathode fluorescent discharge tube according to the present invention.
Figure 4B:
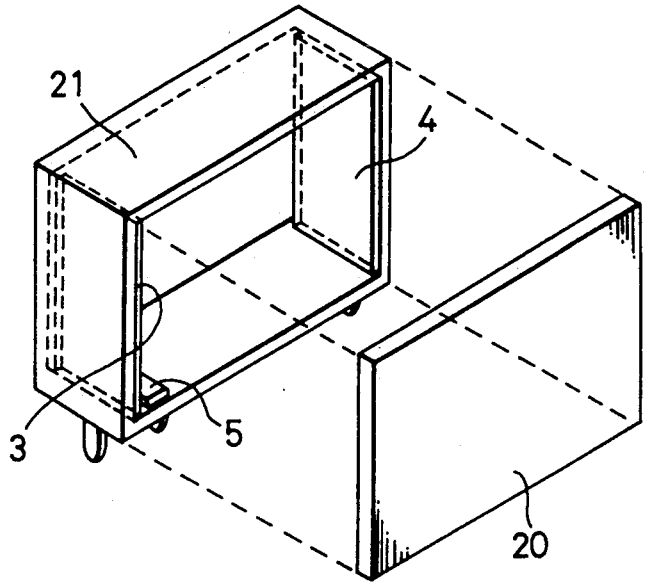
FIG. 4B shows a fragmental, exploded perspective view of the back-light shown in FIG. 4A.
Figure 4C:
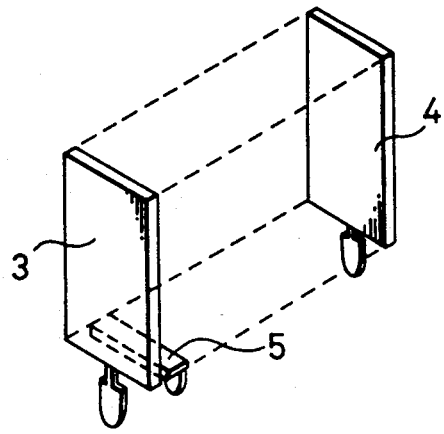
FIG. 4C shows a perspective view of the back-light of FIG. 4A and illustrates an arrangement of electrodes thereof.

FIG. 4A shows a perspective view of a back-light 22 of a liquid crystal display to which the cold-cathode fluorescent discharge tube according to the present invention is applied. In this example, the back-light 22 is formed by a glass casing 21, a glass plate 20, and a cold-cathode fluorescent discharge tube having the electrodes 3, 4 and the auxiliary electrode 5 which are arranged as shown in FIG. 4C. The cold-cathode fluorescent discharge tube is unitarily mounted within the glass casing 21 as shown in FIG. 4B. The glass casing 21 has an opening for receiving the cold-cathode fluorescent discharge tube and an inner wall coated with the phosphor. An inner wall of the glass plate 20 is also coated with the phosphor.

The thus constituted back-light 22 has a flat configuration, so that it may be used as a back-light of a liquid crystal view finder for a video camera, for example. In this case, the view finder of the video camera can quickly display an image of an object in response to the application of power even if it has been placed in the dark at a low temperature for a long period of time.

As set out above, according to the present invention, since an auxiliary electrode is provided in the vicinity of the electrode constituting the cold-cathode fluorescent discharge tube, the discharge is firstly started between the auxiliary electrode and the electrode disposed in the vicinity thereof in response to the application of the voltage between the electrodes, so that the discharge is thereafter surely started between the electrodes. Accordingly, the present invention is advantageous in that the stable discharge state can be formed between the electrodes in a relatively short time after the application of power.

Having described the preferred embodiments of the invention with reference to the accompanying drawings, it is to be understood that the invention is not limited to those precise embodiments and that various changes and modifications thereof could be effected by one skilled in the art without departing from the spirit or scope of the invention as defined in the appended claims.

What is claimed is:

1. A cold-cathode fluorescent discharge tube for use as a back-light, comprising:
   - an electrode pair comprising a first electrode and a second electrode;
   - at least one auxiliary electrode located near said first electrode;
   - an enclosure for housing said auxiliary electrode and said electrode pair;
   - means for applying a first voltage across said first electrode and said second electrode and for also applying a second voltage across said first electrode and said auxiliary electrode;
   - a display, wherein said cold-cathode fluorescent discharge tube is a back-light for said display; and
   - wherein, after said applying means applies said first voltage and said second voltage, a first discharge is first initiated across said first electrode and auxiliary electrode and then a second discharge is later initiated across said first electrode and said second electrode;
   - whereby said display is visible upon the initiation of said first discharge.

2. A cold-cathode fluorescent discharge tube according to claim 1, wherein said applying means comprises a power supply for supplying said first and second voltages and a resistor connected between said second electrode and said auxiliary electrode.

3. A cold-cathode fluorescent discharge tube according to claim 1, further comprising a second auxiliary electrode located near said second electrode and said applying means further comprises means for applying a third voltage across said second electrode and said second auxiliary electrode.

4. A cold-cathode fluorescent discharge tube according to claim 1, further comprising a capacitor connected between said auxiliary electrode and ground.

5. A cold-cathode fluorescent discharge tube according to claim 1, wherein said display comprises a liquid crystal display.

6. A cold-cathode fluorescent discharge tube according to claim 1, wherein said enclosure comprises a glass casing and a glass plate.

* * * * *